US007733322B2

(12) United States Patent
Araki et al.

(10) Patent No.: US 7,733,322 B2
(45) Date of Patent: Jun. 8, 2010

(54) LIQUID CRYSTAL DISPLAY DEVICE AND DRIVING METHOD OF THE SAME

(75) Inventors: Shigesumi Araki, Ishikawa-gun (JP); Kazuhiro Nishiyama, Kanazawa (JP); Mitsutaka Okita, Hakusan (JP); Daiichi Suzuki, Sendai (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 759 days.

(21) Appl. No.: 11/564,542

(22) Filed: Nov. 29, 2006

(65) Prior Publication Data

US 2007/0120809 A1 May 31, 2007

(30) Foreign Application Priority Data

Nov. 30, 2005 (JP) ..... 2005-346821
Nov. 8, 2006 (JP) ..... 2006-302543

(51) Int. Cl.
*G09G 3/36* (2006.01)
*G09G 5/00* (2006.01)

(52) U.S. Cl. ..... 345/100; 345/87; 345/211; 345/690

(58) Field of Classification Search ..... 345/87–102
See application file for complete search history.

(56) References Cited

U.S. PATENT DOCUMENTS 6,392,620 B1 * 5/2002 Mizutani et al. ..... 345/88

FOREIGN PATENT DOCUMENTS

| | | |
|---|---|---|
| JP | 2000-214827 | 8/2000 |
| JP | 2002-31790 | 1/2002 |
| JP | 2002-107695 | 4/2002 |
| JP | 2003-215535 | 7/2003 |
| KR | 2002-0080248 | 10/2002 |

* cited by examiner

*Primary Examiner*—Duc Q Dinh
(74) *Attorney, Agent, or Firm*—Oblon, Spivak, McClelland, Maier & Neustadt, L.L.P.

(57) ABSTRACT

A liquid crystal display device includes a liquid crystal display panel having pixels, a light source which illuminates the display panel, and a control unit which controls the display panel and the light source. The control unit includes an insertion unit which causes the pixel to store a first voltage corresponding to a video signal in a first period within one frame period and to store a second voltage corresponding to a non-video signal in a second period that follows the first period, and a driving unit which enables the light source at least in a period corresponding to the first period in which the first voltage is held in the pixel, and disables the light source in a period corresponding to the second period in which the second voltage is held in the pixel, and is configured to set the first and second voltages at different independent values.

17 Claims, 7 Drawing Sheets

LIQUID CRYSTAL DISPLAY DEVICE AND DRIVING METHOD OF THE SAME

CROSS-REFERENCE TO RELATED APPLICATIONS

This application is based upon and claims the benefit of priority from prior Japanese Patent Applications No. 2005-346821, filed Nov. 30, 2005; and No. 2006-302543, filed Nov. 8, 2006, the entire contents of both of which are incorporated herein by reference.

BACKGROUND OF THE INVENTION

1. Field of the Invention

The present invention relates generally to a liquid crystal display device and a method of driving the liquid crystal display device, and more particularly to a liquid crystal display device including an OCB liquid crystal and a method of driving this liquid crystal display device.

2. Description of the Related Art

In general, a liquid crystal display device includes a liquid crystal display panel which includes a pair of substrates and a liquid crystal layer held between the pair of substrates; a surface light source device which illuminates the liquid crystal display panel; and a control unit which controls the liquid crystal display panel and the surface light source device. The liquid crystal display panel has a display section composed of a plurality of display pixels which are arrayed in a matrix. Further, a plurality of source lines are disposed along the columns of the display pixels, and a plurality of gate lines are disposed along the rows of the display pixels. In each display pixel, a pixel switch is disposed near an intersection of the associated source line and gate line.

In the case of driving the above-described liquid crystal display device, a state in which an image is displayed is retained during a 1-frame period by the pixel switch of each display pixel. Thus, compared to a display device such as a cathode-ray tube (CRT), it is difficult to improve the visibility of a moving image.

In order to improve the moving image visibility, for example, in an OCB mode liquid crystal display device, the feature that the responsivity of the OCB mode is very high is made use of, and it has been proposed to perform a black insertion driving scheme in which a period for video display and a period for non-video display are cyclically provided in every 1-frame period (see, e.g., Japanese Patent Applications No. 2000-214827 and No. 2002-107695).

In the above-described OCB mode liquid crystal display device, when the black insertion driving scheme is executed, in order to obtain high contrast, the non-video signal needs to be adjusted to have a minimum-transmittance voltage that is optimal for black display. Thus, in a color-display-type liquid crystal display device, non-video signals need to be independently adjusted so that the non-video signals may have optimal pixel voltages for black display in association with the respective display pixels.

In addition, the non-video signal needs to be set at a voltage or more, at which reverse transition of the OCB liquid crystal (phase transition from a bend alignment state to a splay alignment state) does not occur. This voltage influences the black insertion ratio and the white display voltage.

In general, the optimal pixel voltage for black display is set at a single value for reasons of optical device design of the OCB mode liquid crystal display device. Thus, in a case where the non-video signal set at the optimal value for black display is not at a threshold or more for preventing reverse transition of the OCB liquid crystal, the black insertion ratio or the white display voltage is adjusted so as to make the voltage, at which reverse transition occurs, lower than the optimal voltage for black display.

However, such problems may arise, in some cases, that the contrast and luminance of a display image deteriorate, due to the setting of the non-video signal at the optimal value for black display and at the voltage which can prevent the reverse transition of the OCB liquid crystal, as described above.

BRIEF SUMMARY OF THE INVENTION

The present invention has been made in consideration of the above-described problem, and the object of the invention is to provide a liquid crystal display device and a method of driving the liquid crystal display device, in which the contrast and luminance of a display image are improved.

According to a first aspect of the present invention, there is provided a liquid crystal display device comprising: a liquid crystal display panel which includes a pair of substrates and a liquid crystal layer that is held between the pair of substrates, a surface light source device which illuminates the liquid crystal display panel, and a control unit which controls the liquid crystal display panel and the surface light source device, wherein the liquid crystal display panel includes a plurality of display pixels which are arrayed in a matrix, the control unit includes a non-video signal insertion unit which causes the display pixel to store a pixel voltage corresponding to a video signal in a first period within one frame period, and causes the display pixel to store a pixel voltage corresponding to an non-video signal in a second period that follows the first period; and a surface light source device driving unit which causes light to be emitted from the surface light source device at least in a period corresponding to the first period in which the pixel voltage corresponding to the video signal is held in the display pixel, and turns off the surface light source device in a period corresponding to the second period in which the pixel voltage corresponding to the non-video signal is held in the display pixel, and the pixel voltage corresponding to the non-video signal and the pixel voltage corresponding to the video signal are configured to be set at different independent values.

According to a second aspect of the present invention, there is provided a driving method of a liquid crystal display device comprising a liquid crystal display panel which includes a pair of substrates and a liquid crystal layer that is held between the pair of substrates, a surface light source device which illuminates the liquid crystal display panel, and a control unit which controls the liquid crystal display panel and the surface light source device, the liquid crystal display panel including a plurality of display pixels which are arrayed in a matrix, the method comprising: causing the control unit to store a pixel voltage corresponding to a video signal as a pixel voltage in the display pixel in a first period within one frame period; causing the control unit to store a pixel voltage corresponding to an non-video signal in the display pixel in a second period that follows the first period, the pixel voltage corresponding to the non-video signal being set at an independent voltage which is different from the video signal; and causing light to be emitted from the surface light source device at least in a period corresponding to the first period in which the pixel voltage corresponding to the video signal is held in the display pixel, and turning off the surface light source device in a period corresponding to the second period in which the pixel voltage corresponding to the non-video signal is held in the display pixel.

With the liquid crystal display device and the method of driving the liquid crystal display device, the contrast and luminance of a display image are improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will now be described with reference to the accompanying drawings.

Figure 1:
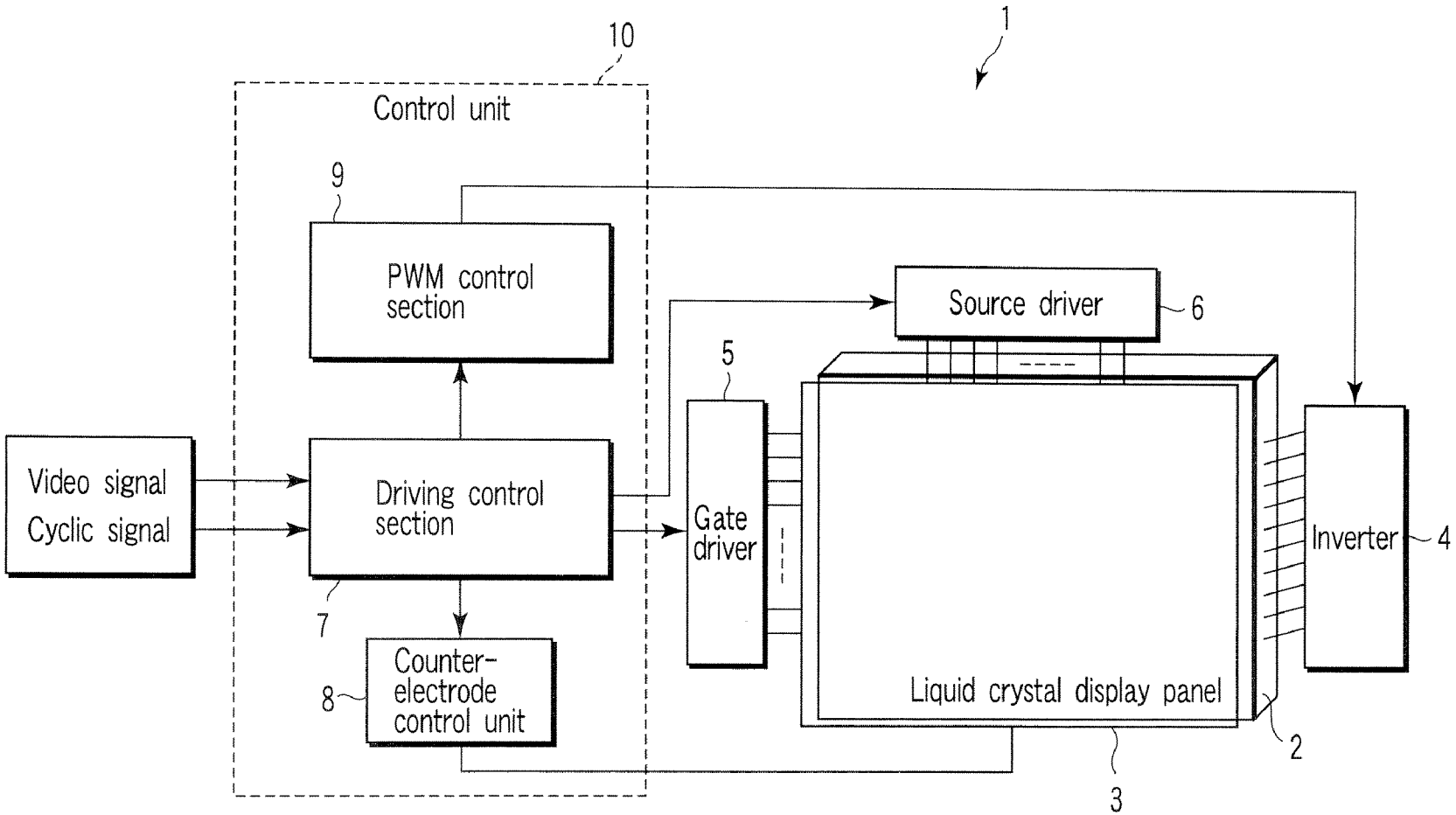
FIG. 1 schematically shows an example of the structure of a liquid crystal display device according to an embodiment of the invention.
Figure 2:
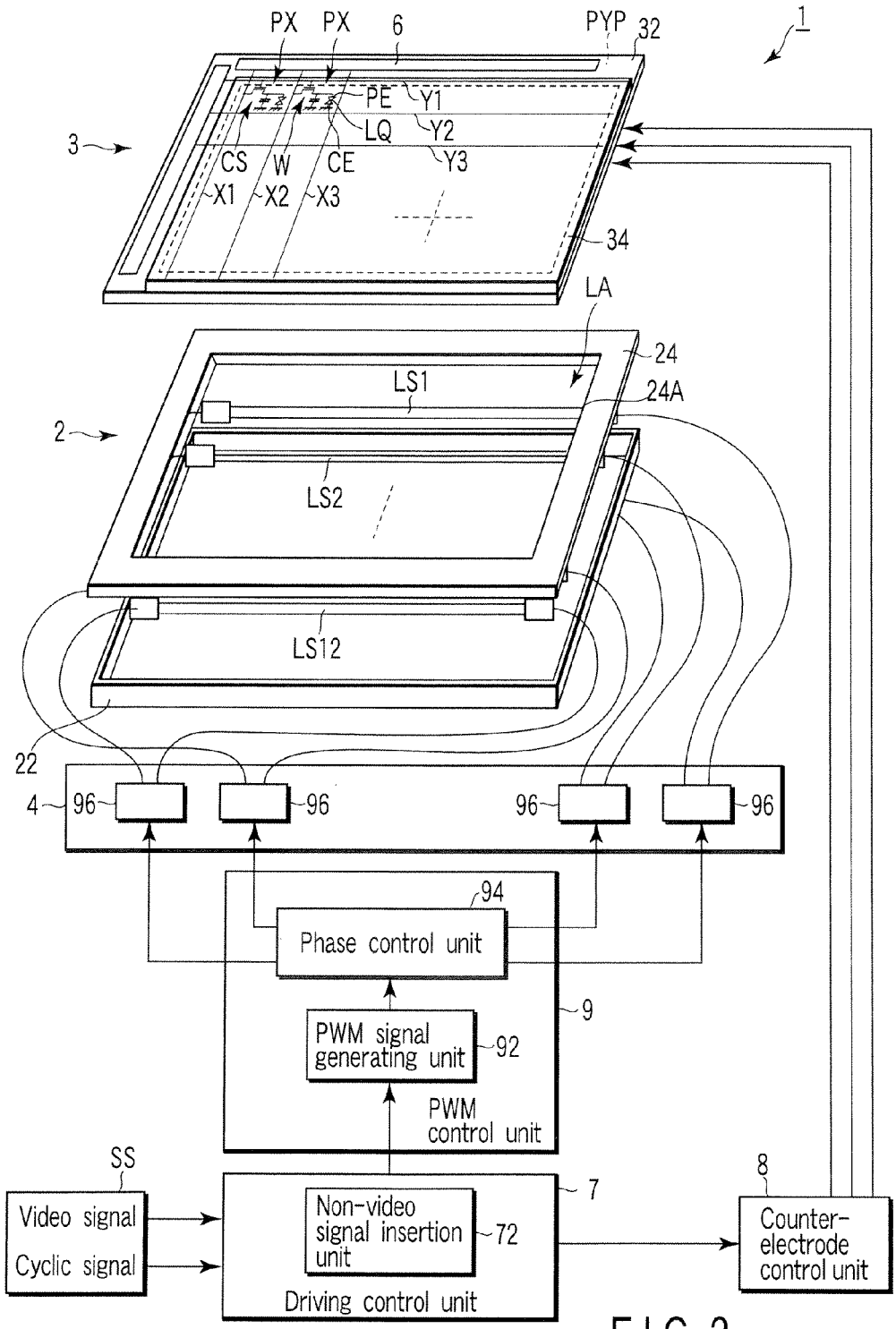
FIG. 2 is a view for describing an example of the structure of a backlight of the liquid crystal display device shown in FIG. 1.

As is shown in FIG. 1 and FIG. 2, a liquid crystal display device 1 according to the embodiment includes a liquid crystal display panel 3, a backlight 2 which illuminates the liquid crystal display panel 3, and a control unit 10 which controls the display panel 3 and backlight 2.

The liquid crystal display panel 3 includes a pair of substrates, i.e., an array substrate 32 and a counter-substrate 34, and a liquid crystal layer LQ which is held between the array substrate 32 and the counter-substrate 34. As shown in FIG. 2, the liquid crystal display panel 3 includes a display section DYP which is composed of a plurality of display pixels PX that are arrayed in a matrix.

The array substrate 32 includes pixel electrodes PE which are disposed in the respective display pixels PX. The array substrate 32 includes source lines X (X1 to Xn) which are arranged along the columns of the pixel electrodes PE; gate lines Y (Y0 to Ym) which are arranged along the rows of the pixel electrodes PE; and pixel switches W which are disposed near intersections of the source lines X and gate lines Y.

The pixel switch W is, for instance, a thin-film transistor (TFT). The gate electrode of the pixel switch W is connected to the associated gate line Y (or formed integral with the associated gate line Y). The source electrode of the pixel switch W is connected to the associated source line X (or formed integral with the associated source line X). The drain electrode of the pixel switch W is connected to the associated pixel electrode PE.

The counter-substrate 34 includes a color filter (not shown) which is disposed on a transparent insulating substrate such as a glass substrate, and a counter-electrode CE which is disposed on the color filter so as to be opposed to the plural pixel electrodes PE.

Each of the pixel electrodes PE and the counter-electrode CE is formed of a transparent electrode material such as ITO. The pixel electrodes PE and the common electrode CE are covered with a pair of alignment films (not shown) which are opposed to each other. In the liquid crystal display device according to this embodiment, the paired alignment films are subjected to rubbing treatment in mutually parallel directions.

The liquid crystal layer LQ of the liquid crystal display device 1 according to this embodiment includes an OCB liquid crystal as a liquid crystal material. In other words, the liquid crystal display device 1 of this embodiment is an OCB mode liquid crystal display device in which the liquid crystal molecules included in the liquid crystal layer LQ transition to a bend alignment state when the liquid crystal display device 1 is in a display state. Each display pixel PX is constituted by the pixel electrode PE, the counter-electrode CE and the liquid crystal layer LQ that is interposed between these electrodes and is controlled to have an orientation of liquid crystal molecules corresponding to an electric field generated from these electrodes.

Each of the display pixels PX includes a storage capacitance Cs which is connected in parallel with a liquid crystal capacitance between the associated pixel electrode PE and counter-electrode CE. In the liquid crystal display device 1 of this embodiment, each storage capacitance Cs is constituted by capacitive coupling between the pixel electrode PE of the display pixel PX and a preceding-stage gate line Y which neighbors the display pixel PX on one side and controls the pixel switch W of the display pixel PX. Each storage capacitance Cs has a sufficiently high magnitude, relative to parasitic capacitances of the pixel switch W, etc., so as to adequately compensate a potential variation in liquid crystal capacitance due to the influence of the parasitic capacitances of the pixel switch X, etc.

The liquid crystal display panel 3 includes driving circuits which drive the plural display pixels PX, that is, a gate driver 5 and a source driver 6. The gate driver 5 is connected to all gate lines Y. The source driver 6 is connected to all source lines X.

The control unit 10 includes a driving control unit 7 which controls the gate driver 5 and source driver 6. Specifically, the gate driver 5 is controlled by the driving control unit 7 to sequentially drive the gate lines Y. Thereby, a current path between the source electrode and the drain electrode of the pixel switch W, which is connected to the driven gate line, is made conductive.

The source driver 6 sequentially drives the source lines X and applies pixel voltages to the associated display pixels PX via the pixel switches W which are connected to the gate line Y that is driven by the gate driver 5. Thus, the pixel voltages are written in the display pixels PX and are retained for a predetermined period i.e., a first period in a 1-frame period until pixel voltages are applied at the next time.

The driving control unit 7 of the control unit 10 controls the transmittance of the liquid crystal display panel 3 by liquid crystal driving voltages which are applied to the liquid crystal layer LQ from the pixel electrodes PE of the array substrate 32 and the counter-electrode CE of the counter-substrate 34.

The transition from the splay alignment state to the bend alignment state of the liquid crystal molecules included in the liquid crystal layer LQ is executed by applying a relatively strong electric field to the liquid crystal layer in a predetermined initializing process which is performed by the driving control unit 7 at the time of power-on.

The driving control unit 7, as shown in FIG. 2, includes a non-video signal insertion unit 72. The non-video signal insertion unit 72 drives the gate driver 5 and source driver 6 and cyclically applies a reverse-transition prevention voltage to the liquid crystal layer LQ. Specifically, the OCB liquid crystal is transitioned in advance from a splay alignment state to a bend alignment state, for example, in order to perform a normally white display operation. Reverse transition from the bend alignment state to splay alignment state is prevented by the reverse-transition prevention voltage that is cyclically applied.

In the liquid crystal display device according to this embodiment, a non-video signal is cyclically applied as the reverse-transition prevention voltage. In the case of the liquid crystal display device according to this embodiment, the non-video signal has a maximum settable voltage with an equal value for all the display pixels PX.

To be more specific, the same voltage is applied as the non-video signal to all of a plurality of kinds of display pixels, such as red pixels, green pixels and blue pixels, which are classified according to the colors of color filters disposed on the respective display pixels PX.

Figure 4:
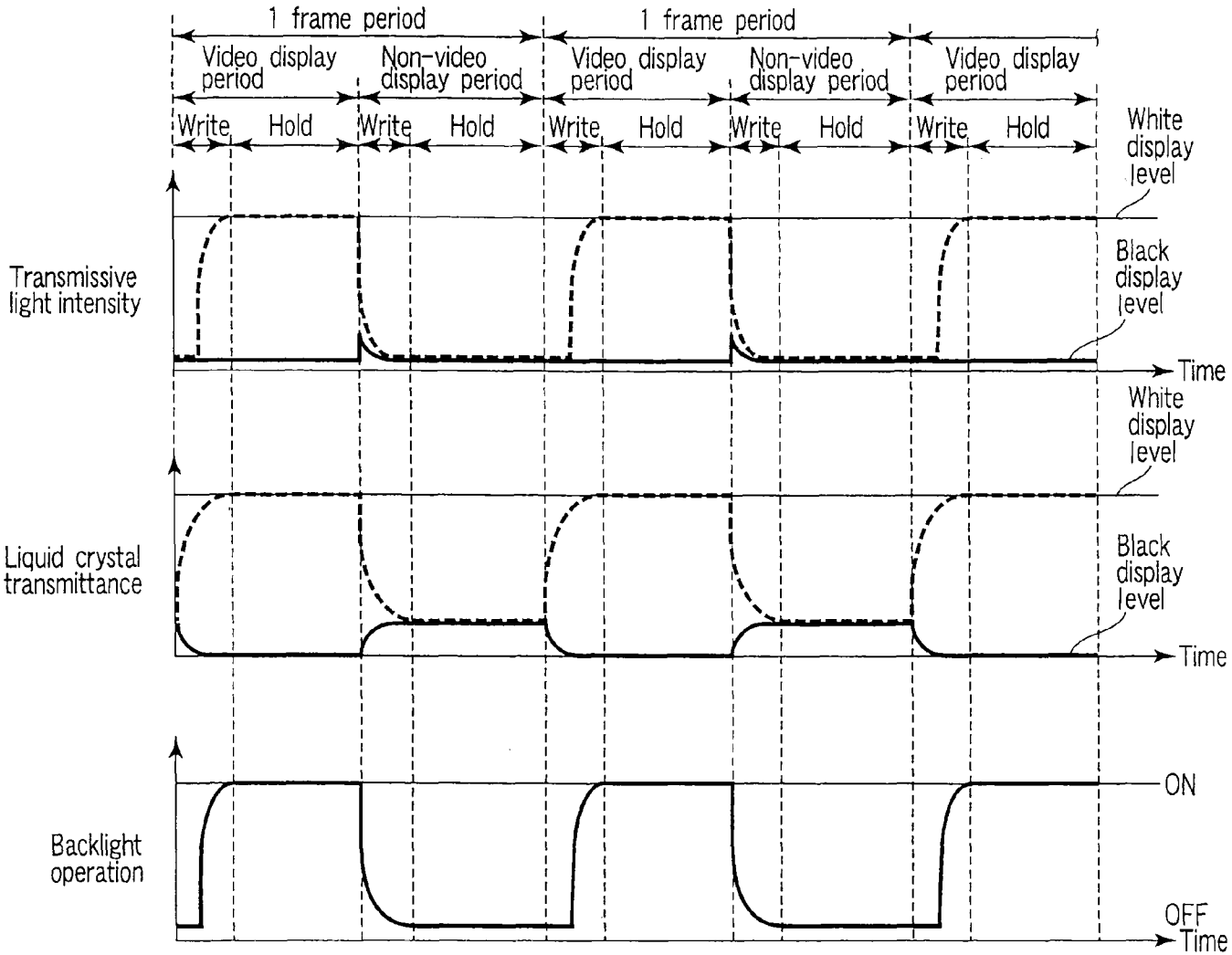
FIG. 4 is a view for describing an example of a driving method of the liquid crystal display device shown in FIG. 1.

In the liquid crystal display device 1 according to this embodiment, as shown in FIG. 4, the non-video signal insertion unit 72 divides one frame period into a video display period as a first period and a non-video display period as a second period.

The non-video signal insertion unit 72 controls the gate driver 5 and source driver 6 in accordance with a video signal and a cyclic signal which are input from an external signal source SS. In the video display period within a 1-frame period, the non-video signal insertion unit 72 writes the video signal as a pixel voltage in the display pixel PX, and holds the video signal. In the non-video display period following the video display period, the non-video signal insertion unit 72 writes the non-video signal as a pixel voltage in the display pixel PX, and holds the non-video signal.

The control unit 10 also includes a counter-electrode control unit 8 which controls a counter-voltage that is to be applied to the counter-electrode CE, and a PWM control unit 9 which controls the backlight 2 via an inverter 4. The counter-electrode control unit 8 applies a counter-voltage to the counter-electrode CE of the liquid crystal display panel 3. At this time, the counter-voltage is so set as to impart predetermined polarities to the pixel voltages that are applied to the plural display pixels PX.

As is shown in FIG. 2, the backlight 2 includes a plurality of cold-cathode fluorescent tubes LS (LS1 to LS12) functioning as light sources, a back cover 22 which supports the cold-cathode fluorescent tubes LS, and a top cover 24 which engages the back cover 22 and has a substantially rectangular window part 24A which defines a light emission part LA of the backlight 2. The backlight 2 is disposed on the back side of the liquid crystal display panel 3 such that the light emission part LA corresponds to the display section DYP of the liquid crystal display panel 3.

The backlight 2 includes optical sheets (not shown) such as a reflection sheet which reflects light that is emitted from the cold-cathode fluorescent tubes LS to the back cover 22 side, and a diffusion sheet which diffuses light that is emitted from the cold-cathode fluorescent tubes LS.

The cold-cathode fluorescent tubes LS are connected to the inverter 4, as shown in FIG. 2. The inverter 4 includes a plurality of conversion units 96 which apply driving voltages to the anodes and cathodes of the respective cold-cathode fluorescent tubes LS.

The conversion units 96 are controlled by the PWM control unit 9 of the control unit 10. The PWM control unit 9 includes a PWM signal generating unit 92 and a phase control unit 94. The PWM signal generating unit 92 outputs a dimmer pulse which is synchronized with the cyclic signal from the driving control unit 7 and has a set duty ratio.

The dimmer pulse that is output from the PWM signal generating unit 92 is input to the phase control unit 94. The phase control unit 94 shifts the phase of the input dimmer pulse and outputs the dimmer pulse with the shifted phase in order to successively turn on and off the cold-cathode fluorescent tubes LS. In short, the phase control unit 94 controls the on/off timing (phase) of each cold-cathode fluorescent tube LS.

Figure 3:
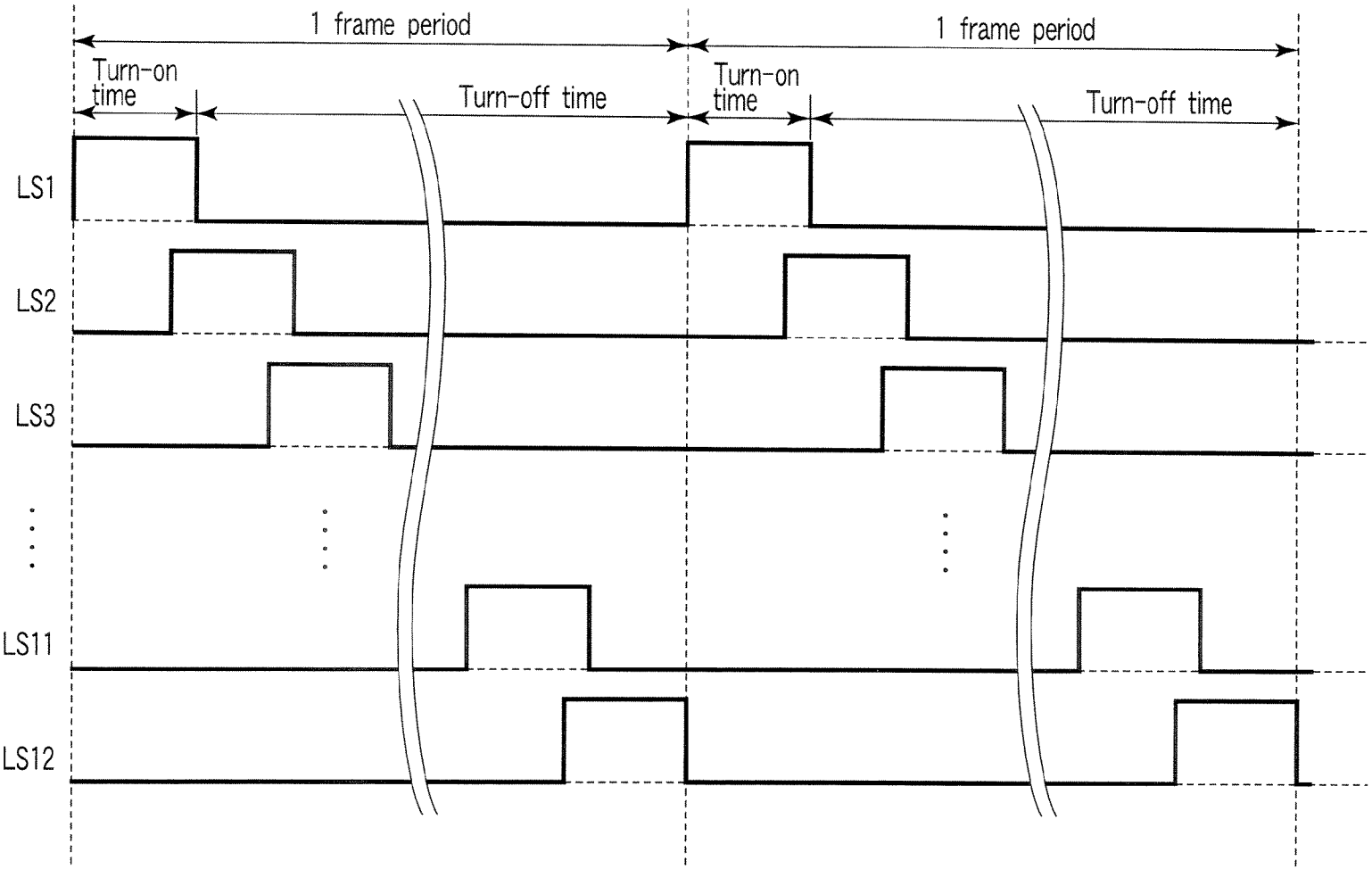
FIG. 3 is a view for describing a driving method for the backlight of the liquid crystal display device shown in FIG. 1.

The dimmer pulse, which is output from the phase control unit 94, is input to the associated conversion unit 96 and converted to a voltage by the conversion unit 96. The obtained voltage is output to the associated cold-cathode fluorescent tube LS. Thus, as shown in FIG. 3, for example, the cold-cathode fluorescent tubes LS can be driven such that turn-on/off periods thereof are successively shifted.

Specifically, the backlight 2 of the liquid crystal display device 1 according to this embodiment is a blinking backlight wherein the light emission part LA includes a plurality of turn-on areas, and the turn-on areas can successively be turned on/off. The blinking backlight is a backlight which can control the duty ratio and on/off timing (phase) of the pulse signal that drives the backlight.

In the present embodiment, as shown in FIG. 4, the backlight 2 is turned on at least in a period in which the video signal is held during the video display period within a 1-frame period, and turned off in a period in which the non-video signal is held during the non-video display period within the 1-frame period.

Next, a driving method of the liquid crystal display device according to this embodiment is described. In the liquid crystal display device according to this embodiment, the liquid crystal display panel 3 and backlight 2 are driven, as illustrated in FIG. 4. Specifically, a video display period and a non-video display period are provided in 1-frame period. In the video display period, the driving control unit 7 writes a video signal as a pixel voltage in the display pixel PX. The video signal that is written in the display pixel PX is held during a predetermined period within the video display period.

In the non-video display period following the video display period, the driving control unit 7 writes a non-video signal as a pixel voltage in the display pixel PX. The non-video signal that is written in the display pixel PX is held during a predetermined period within the non-video display period. At this time, the non-video signal, which is applied to the display pixel PX as a pixel electrode voltage, is a maximum settable voltage in the driving control unit 7.

To be more specific, the non-video signal is a voltage that is an independently set voltage, which is different from a black display voltage. The non-video signal is the same voltage for all of a plurality of kinds of display pixels, such as red pixels, green pixels and blue pixels, which are classified according to the colors of color filters disposed on the respective display pixels PX. In the liquid crystal display device according to this embodiment, the non-video signal is set at a maximum voltage value that is settable by the driving control unit 7.

According to the liquid crystal display device of this embodiment, when (in the case where) the transmittance takes a minimum value, the voltage applied to the liquid crystal layer LQ is 4.5v. In contrast, the voltage of the non-video signal is set to be 5v which is greater than the voltage (4.5v) applied to the liquid crystal layer LQ and effectively prevents reverse transition.

The turn on/off timing of the backlight 2 is controlled by the PWM control unit 9 in sync with the operation of the liquid crystal display panel 3. Specifically, the PWM control unit 9 controls the inverter 4 so that the backlight 2 emits light at least in a period in which the video signal is held in the display pixel PX during the video display period. In addition, the PWM control unit 9 controls the inverter 4 so that the backlight 2 is turned off at least in a period in which the non-video signal is held in the display pixel PX during the non-video display period.

The PWM signal generating unit 92 outputs a dimmer pulse which is synchronized with the cyclic signal from the driving control unit 7 and has a set duty ratio. The dimmer pulse that is output from the PWM signal generating unit 92 is input to the phase control unit 94. The phase control unit 94 shifts the phase of the input dimmer pulse in accordance with the timing of the cyclic signal in order to successively turn on and off the cold-cathode fluorescent tubes LS, and outputs the dimmer pulse with the shifted phase.

In the liquid crystal display device according to the present embodiment, as shown in FIG. 4, the phase control unit 94 shifts the phase of the dimmer pulse so that each cold-cathode fluorescent tube LS is turned on at a timing when the video signal is written in a predetermined display pixel PX and each cold-cathode fluorescent tube LS is turned off at a timing when the non-video signal is written in the predetermined display pixel PX The dimmer pulse, which is output from the phase control unit 94, is input to the associated conversion unit 96 and converted to a voltage by the conversion unit 96. The obtained voltage is output to the associated cold-cathode fluorescent tube LS. Thus, as shown in FIG. 4, the cold-cathode fluorescent tubes LS are controlled to be turned on in the period in which the video signal is held in the predetermined display pixel PX, and to be turned off in the period in which the non-video signal is held in the predetermined display pixel PX.

Figure 5:
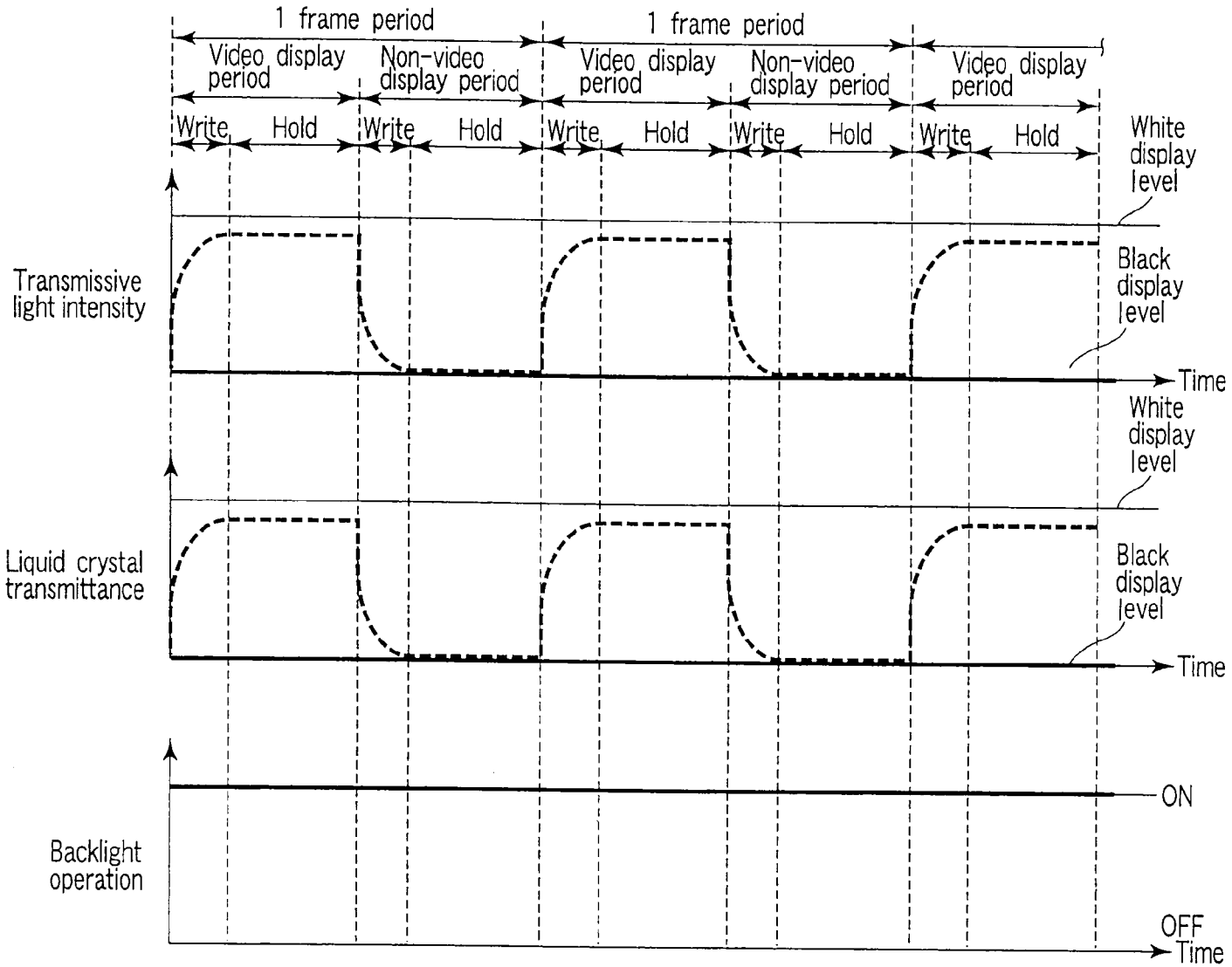
FIG. 5 is a view for describing an example of a driving method of a prior-art liquid crystal display device.

For the purpose of comparison, driving methods of prior-art OCB liquid crystal display devices will be described below. In the prior art, the OCB liquid crystal display device is driven, for example, as shown in FIG. 5. Specifically, one frame period includes a video display period in which a video signal is written and held as a pixel voltage, and a non-video display period in which a non-video signal is written and held as a pixel voltage.

In the prior-art liquid crystal display device, the backlight 2 is turned on during 1-frame period. Even in the non-video display period within the 1 frame period, the backlight is turned on. Thus, in the prior art, the non-video signal, which is applied as the pixel voltage, is set at a voltage at which the liquid crystal transmittance takes a minimum value. In short, the non-video signal is set at a voltage corresponding to black display.

In this case, since the non-video signal has to be set at the voltage of the black display level, reverse transition is prevented by adjusting the black insertion ratio and the white display voltage. In the case of the OCB liquid crystal, the effect of preventing reverse transition is higher as the voltage applied to the liquid crystal layer LQ is higher. However, in the case shown in FIG. 5, since the backlight 2 is turned on in the non-video display period, the non-video signal has to be set at the black display level, and the voltage, which is applied as the non-video signal in order to enhance the reverse-transition prevention effect, cannot be raised. As a result in the prior art, the reverse transition has been prevented by increasing the black insertion ratio or by lowering the pixel voltage for white display.

However, there is a limit to the increase in black insertion ratio. In addition, when the pixel voltage at the time of white display is to be decreased, the pixel voltage, which is applied to the liquid crystal display device at the time of white display, cannot be set at a value at which the liquid crystal transmittance takes a maximum value. As a result, the transmissive light intensity becomes lower than the white display level, and the contrast decreases.

Figure 6:
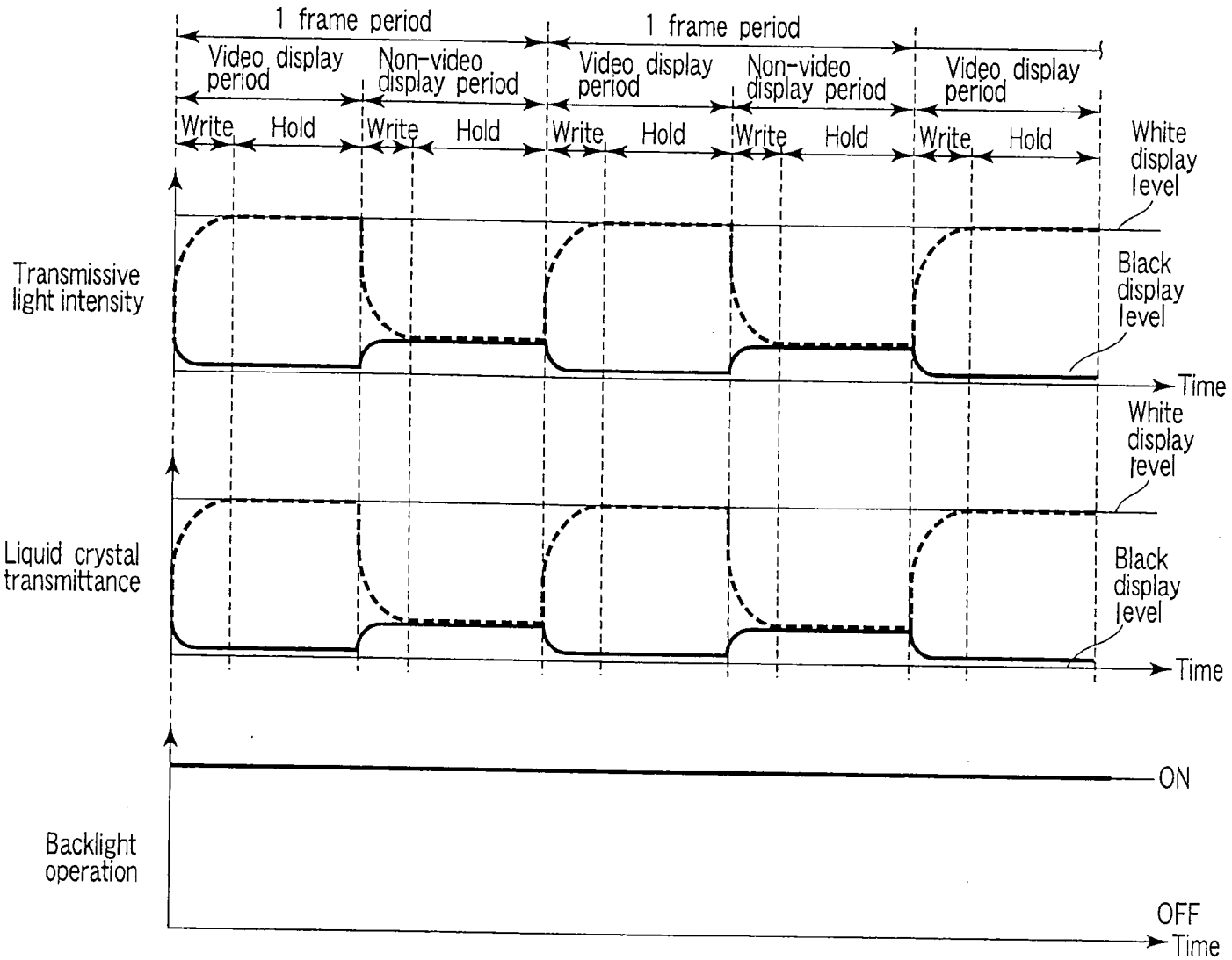
FIG. 6 is a view for describing an example of a driving method of a prior-art liquid crystal display device.

On the other hand, as shown in FIG. 6, if the pixel voltage at the time of white display is set at a value at which the liquid crystal transmittance takes a maximum value, the value of the non-video signal could not be set at the voltage of the black display level. In the video display period, when white display is executed, the liquid crystal transmittance and transmissive light intensity can be set at the white display level. However, in the non-video display period, the liquid crystal transmittance does not decrease to the minimum level. As a result, the transmissive light intensity at the time of black display becomes higher than the black display level, and the contrast decreases.

Figure 7:
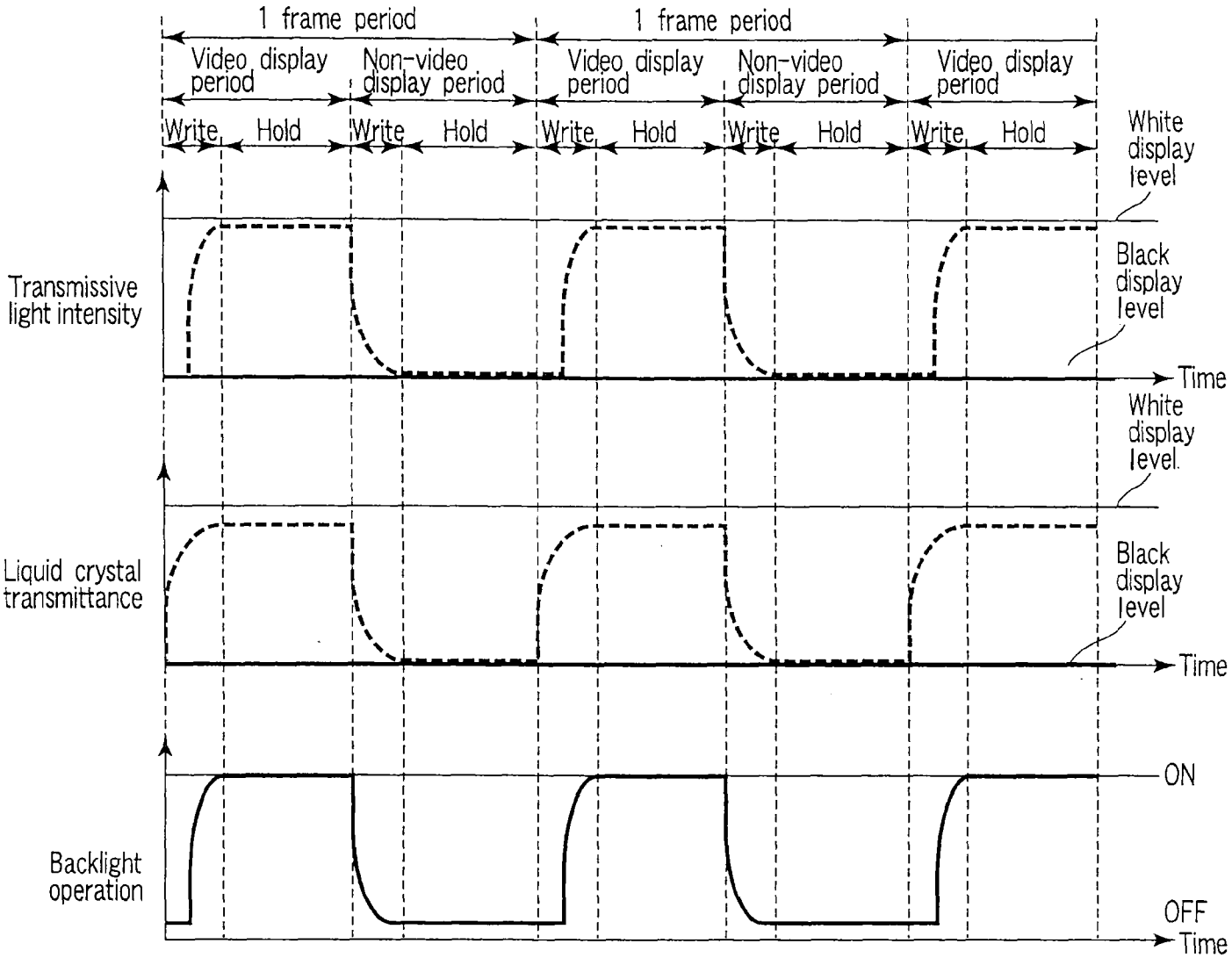
FIG. 7 is a view for describing an example of a driving method of a prior-art liquid crystal display device which includes a blinking backlight.

In the prior-art case shown in FIG. 7, like the liquid crystal display device according to the present embodiment, the backlight 2 is turned on and turned off in 1-frame period. Further, like the case shown in FIG. 4, the non-video signal is set at the voltage at which the liquid crystal transmittance takes a minimum value.

In the non-video display period, the liquid crystal transmittance takes a minimum value, and the transmissive light intensity also takes a minimum value. However, since the non-video signal is set at a voltage at which the liquid crystal transmittance takes a minimum value, there is a restriction to the pixel voltage at the time of white display, like the case shown in FIG. 4. Consequently, in the video display period, the liquid crystal transmittance decreases at the time of white display, and the transmissive light intensity decreases. As a result, the contact decreases.

As described above, in the prior-art liquid crystal display devices, there are restrictions to the non-video signal, white display voltage and black insertion ratio, leading to a decrease in contrast of the display image. By contrast, in the liquid crystal display device according to the present embodiment, the PWM control unit 9 sets, in the video display period, the pixel voltage at the time of white display at the value at which the liquid crystal transmittance takes a maximum value.

In the case of the liquid crystal display device according to the present embodiment, the non-video signal has a maximum settable voltage, which is the same voltage for all the display pixels. In other words, the same voltage is applied as the non-video signal to all of a plurality of kinds of display pixels, such as red pixels, green pixels and blue pixels, which are classified according to the colors of color filters disposed on the respective display pixels PX.

Accordingly, the liquid crystal transmittance in the non-video display period is higher than the black display level at which the liquid crystal transmittance is minimum. However, since the backlight 2 is turned off, at least, in the period in which the non-video signal is held during the non-video display period, the transmissive light intensity does not increase.

If the liquid crystal display device 1 is driven as described above, the setting range of the pixel voltage and black insertion ratio at the time of white display can be made wider than in the case of the prior-art liquid crystal display device in which the non-video signal is set at the voltage at which the liquid crystal transmittance is minimum. Hence, the degree of freedom of design of the liquid crystal display device 1 can be increased. Therefore, compared to the prior-art liquid crystal display device, the liquid crystal transmittance at the time of white display can be increased and the contrast of the display image can be improved.

The effect of preventing reverse transition is higher as the reverse-transition prevention voltage is higher. Thus, by setting the reverse-transition prevention voltage at the maximum voltage that is settable by the device, various designs relating to the reverse transition can be made easy. Furthermore, by using the fixed voltage, the cost for fabrication steps necessary for voltage adjustment can be reduced.

Moreover, if the liquid crystal display device 1 is driven as described above, the non-video signal can be set at a value different from the value at which the liquid crystal transmittance takes a minimum value. Thus, there is no need to vary the non-video signal between the respective kinds of display pixels, such as the red pixels, green pixels and blue pixels. Therefore, the non-video signal can be set at the same value for all pixels, and the cost of the driver circuits and peripheral circuits that are used in the device can be reduced.

The present embodiment can provide a liquid crystal display device and a driving method of the liquid crystal display device, which can improve the contrast and luminance of a display image in the OCB mode.

The present invention is not limited directly to the above-described embodiment. In practice, the structural elements can be modified without departing from the spirit of the invention. For example, the non-video signal may be set at a voltage different from the value at which the liquid crystal transmittance takes a minimum value, and may be set at different values between the respective kinds of display pixels, such as the red pixels, green pixels and blue pixels.

Thereby, the same advantageous effect as with the liquid crystal display device of this embodiment can be obtained, and it becomes possible to perform black chroma adjustment by adjusting the chroma of slight light that leaks during the non-video display period. Besides, since the response speeds of the respective kinds of display pixels, such as red pixels, green pixels and blue pixels, can be varied, the chroma adjustment of white and intermediate gradations can be performed.

Various inventions can be made by properly combining the structural elements disclosed in the embodiment. For example, some structural elements may be omitted from all the structural elements disclosed in the embodiment. Furthermore, structural elements in different embodiments may properly be combined.

What is claimed is:

1. A liquid crystal display device comprising:

an OCB liquid crystal display panel which includes a pair of substrates and an OCB liquid crystal layer that is held between the pair of substrates;

a surface light source device which illuminates the liquid crystal display panel; and a control unit which controls the liquid crystal display panel and the surface light source device, wherein the liquid crystal display panel includes a plurality of display pixels which are arrayed in a matrix, the control unit includes a non-video signal insertion unit which causes the display pixel to store a pixel voltage corresponding to a video signal in a first period within one frame period, and causes the display pixel to store a pixel voltage corresponding to an non-video signal in a second period that follows the first period; and a surface light source device driving unit which causes light to be emitted from the surface light source device at least in a period corresponding to the first period in which the pixel voltage corresponding to the video signal is held in the display pixel, and turns off the surface light source device in a period corresponding to the second period in which the pixel voltage corresponding to the non-video signal is held in the display pixel, and the pixel voltage corresponding to the non-video signal is configured to be set to a voltage which is greater than a voltage at which a liquid crystal transmittance takes a minimum value and which is at independent values compared to the pixel voltage corresponding to the video signal.

2. The liquid crystal display device according to claim 1, wherein the liquid crystal layer includes a liquid crystal material including liquid crystal molecules which are transitioned to a bend alignment state in a display state.

3. The liquid crystal display device according to claim 1, wherein the surface light source device includes a plurality of light sources, and the surface light source device driving unit is configured to successively drive the plurality of light sources.

4. The liquid crystal display device according to claim 3, wherein each of the plurality of light sources, which are successively driven, has a linear shape.

5. The liquid crystal display device according to claim 1, wherein the plurality of display pixels are classified into a plurality of kinds of display pixels, and the pixel voltage corresponding to the non-video signal, which is applied to each of the plurality of kinds of display pixels, has an equal voltage.

6. The liquid crystal display device according to claim 5, wherein the plurality of kinds of display pixels have mutually different display colors.

7. The liquid crystal display device according to claim 6, wherein the plurality of kinds of display pixels include a red display pixel corresponding to red display, a green display pixel corresponding to green display, and a blue display pixel corresponding to blue display.

8. The liquid crystal display device according to claim 6, wherein the pixel voltage corresponding to the non-video signal has an independent value with respect to each of the plurality of kinds of display pixels, and has a value which is adjusted such that a display image has a desired chroma.

9. The liquid crystal display device according to claim 1, wherein the pixel voltage corresponding to the non-video signal has a maximum voltage value which is settable in the control unit.

10. A driving method of a liquid crystal display device comprising an OCB liquid crystal display panel which includes a pair of substrates and an OCB liquid crystal layer that is held between the pair of substrates, a surface light source device which illuminates the liquid crystal display panel, and a control unit which controls the liquid crystal display panel and the surface light source device, the liquid crystal display panel including a plurality of display pixels which are arrayed in a matrix, the method comprising:

causing the control unit to store a pixel voltage corresponding to a video signal as a pixel voltage in the display pixel in a first period within one frame period;

causing the control unit to store a pixel voltage corresponding to an non-video signal in the display pixel in a second period that follows the first period, the pixel voltage corresponding to the non-video signal being set to a voltage which is greater than a voltage at which a liquid crystal transmittance takes a minimum value and which is an independent voltage compared to the pixel voltage corresponding to the video signal; and causing light to be emitted from the surface light source device at least in a period corresponding to the first period in which the pixel voltage corresponding to the video signal is held in the display pixel, and turning off the surface light source device in a period corresponding to the second period in which the pixel voltage corresponding to the non-video signal is held in the display pixel.

11. The driving method of a liquid crystal display device, according to claim 10, wherein the control unit sets the liquid crystal display panel in a display state by transitioning liquid crystal molecules included in the liquid crystal layer to a bend alignment state.

12. The driving method of a liquid crystal display device, according to claim 10, wherein the surface light source device includes a plurality of light source, and the control unit successively drives the plurality of light sources.

13. The driving method of a liquid crystal display device, according to claim 12, wherein each of the plurality of light sources, which are successively driven, has a linear shape.

14. The driving method of a liquid crystal display device, according to claim 10, wherein the plurality of display pixels are classified into a plurality of kinds of display pixels, and the control unit sets the pixel voltage corresponding to the non-video signal, which is applied to each of the plurality of kinds of display pixels, at a substantially equal voltage.

15. The driving method of a liquid crystal display device, according to claim 14, wherein the plurality of kinds of display pixels have mutually different display colors.

16. The driving method of a liquid crystal display device, according to claim 10, wherein the control unit sets the pixel voltage corresponding to the non-video signal at a maximum voltage value which is settable.

17. The driving method of a liquid crystal display device, according to claim 10, wherein the control unit adjusts the pixel voltage corresponding to the non-video signal, which is applied to each of the plurality of kinds of display pixels, and executes chroma adjustment of a display image.

* * * * *